US012320218B2

(12) United States Patent
Alghazali et al.

(10) Patent No.: US 12,320,218 B2
(45) Date of Patent: Jun. 3, 2025

(54) SLIDING WIRELINE CATCHER AND CUTTER FOR LOST DOWNHOLE WIRE

(71) Applicant: SAUDI ARABIAN OIL COMPANY, Dhahran (SA)

(72) Inventors: Mohieddin Attig Ali Alghazali, Udhailiyah (SA); Fahmi Aulia, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 204 days.

(21) Appl. No.: 18/170,805

(22) Filed: Feb. 17, 2023

(65) Prior Publication Data

US 2024/0279995 A1 Aug. 22, 2024

(51) Int. Cl.
*E21B 29/04* (2006.01)
*E21B 31/00* (2006.01)

(52) U.S. Cl.
CPC ..... *E21B 29/04* (2013.01); *E21B 31/00* (2013.01)

(58) Field of Classification Search
CPC ..... E21B 29/04; E21B 31/10
See application file for complete search history.

(56) References Cited

U.S. PATENT DOCUMENTS

| | | | | |
|---|---|---|---|---|
| 3,967,647 | A * | 7/1976 | Young | E21B 29/04 166/368 |
| 6,763,753 | B1 * | 7/2004 | Brumley | E21B 29/04 83/639.1 |
| 10,156,111 | B2 * | 12/2018 | Clemens | E21B 29/04 |
| 10,392,889 | B2 | 8/2019 | Kartha et al. | |
| 2021/0270102 | A1 * | 9/2021 | Massey | E21B 29/04 |

FOREIGN PATENT DOCUMENTS

CN 111236875 A 6/2020

OTHER PUBLICATIONS

"Go Devils Slickline Downhole Tools", Hunting; Feb. 17, 2023; Retrieved from the Internet: URL: http://www.hunting-intl.com/media/3828236/GO%20Devils.pdf (1 page).

* cited by examiner

*Primary Examiner* — Tara Schimpf
*Assistant Examiner* — Daniel T Craig
(74) *Attorney, Agent, or Firm* — Osha Bergman Watanabe & Burton LLP

(57) ABSTRACT

A system for fishing a wire lost downhole in a wellbore includes a wire catcher assembly and a wire cutter assembly. The wire catcher assembly includes a body that encases an end of the wire, a wire guide attached to the body which directs the end of the wire into the body, a gripping mechanism that secures the wire within the body, and a wireline unit that moves the wire catcher assembly within the wellbore. The wire cutter assembly includes a cutting element that cuts the wire and a housing that positions the cutting element along the wire in the wellbore.

19 Claims, 7 Drawing Sheets

SLIDING WIRELINE CATCHER AND CUTTER FOR LOST DOWNHOLE WIRE

BACKGROUND

In the oil and gas industry, hydrocarbon fluids are commonly found in hydrocarbon reservoirs. These hydrocarbon reservoirs are located far below the surface of the earth in porous rock formations. In order to access the hydrocarbon fluids, wells are drilled into the formations. Furthermore, a number of electrical systems may be deployed within a wellbore of the well to perform various operations. In conventional methods, power is provided to the electrical systems or downhole tools from external sources at the surface via cables. For example, an electrical cable, or a wireline, may be employed to provide power to submerged process control equipment, pumps and compressors, transformers, motors, and other electrically operated equipment downhole in the wellbore. Commonly, a wireline is formed of braided cables and may also be used to transmit data about the conditions of the wellbore to the surface. In addition to a wireline or separate of a wireline, a slickline may be run in the wellbore. A slickline is a nonelectric cable utilized to set and retrieve wellbore tools, such as a plug.

While drilling the well or during daily operations of the well, equipment or junk often becomes lost or lodged within the well and is referred to as a "fish." Typically, regular drill bits cannot drill through fish. Should a fish fall into a well, a "fishing job" is required to remove the fish from the well, or otherwise clear the well of the fish. One of the most challenging fishing jobs is the recovery of a tool or instrument run with a wireline or slickline when the wireline or slickline has been cut and is lost downhole.

SUMMARY

One or more embodiments of the present invention relate to a system for fishing a wire lost downhole in a wellbore that includes a wire catcher assembly and a wire cutter assembly. The wire catcher assembly includes a body that encases an end of the wire, a wire guide attached to the body which directs the end of the wire into the body, a gripping mechanism that secures the wire within the body, and a wireline unit that moves the wire catcher assembly within the wellbore. The wire cutter assembly includes a cutting element that cuts the wire and a housing that positions the cutting element along the wire in the wellbore.

One or more embodiments of the present invention relate to a method for fishing a wire lost downhole in a wellbore that includes transporting a wire catcher assembly downhole in the wellbore from a surface location with a wireline unit, directing an end of the wire into a body of a wire catcher assembly with a wire guide of the wire catcher assembly, and securing the end of the wire within the body of the wire catcher assembly with a gripping mechanism of the wire catcher assembly. The method further includes positioning a cutting element of the wire cutter assembly along the wire in the wellbore by a housing of a wire cutter assembly, cutting the wire with the cutting element of the wire cutter assembly, and transporting the wire catcher assembly and the cut wire to the surface location with the wireline unit.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

This disclosure describes systems for and methods of returning a wire lost downhole in a wellbore to a surface location using a wire catcher assembly and a wire cutter assembly. Accordingly, the wire catcher assembly includes a body, a wire guide, a gripping mechanism, and a wireline unit. The wire cutter assembly includes a cutting element and a housing. The techniques discussed in this disclosure are beneficial in increasing the rate of success for removing a lost wire from a wellbore, as well as reducing the operational risk of causing the lost wire to become nested within the wellbore.

Figure 1:
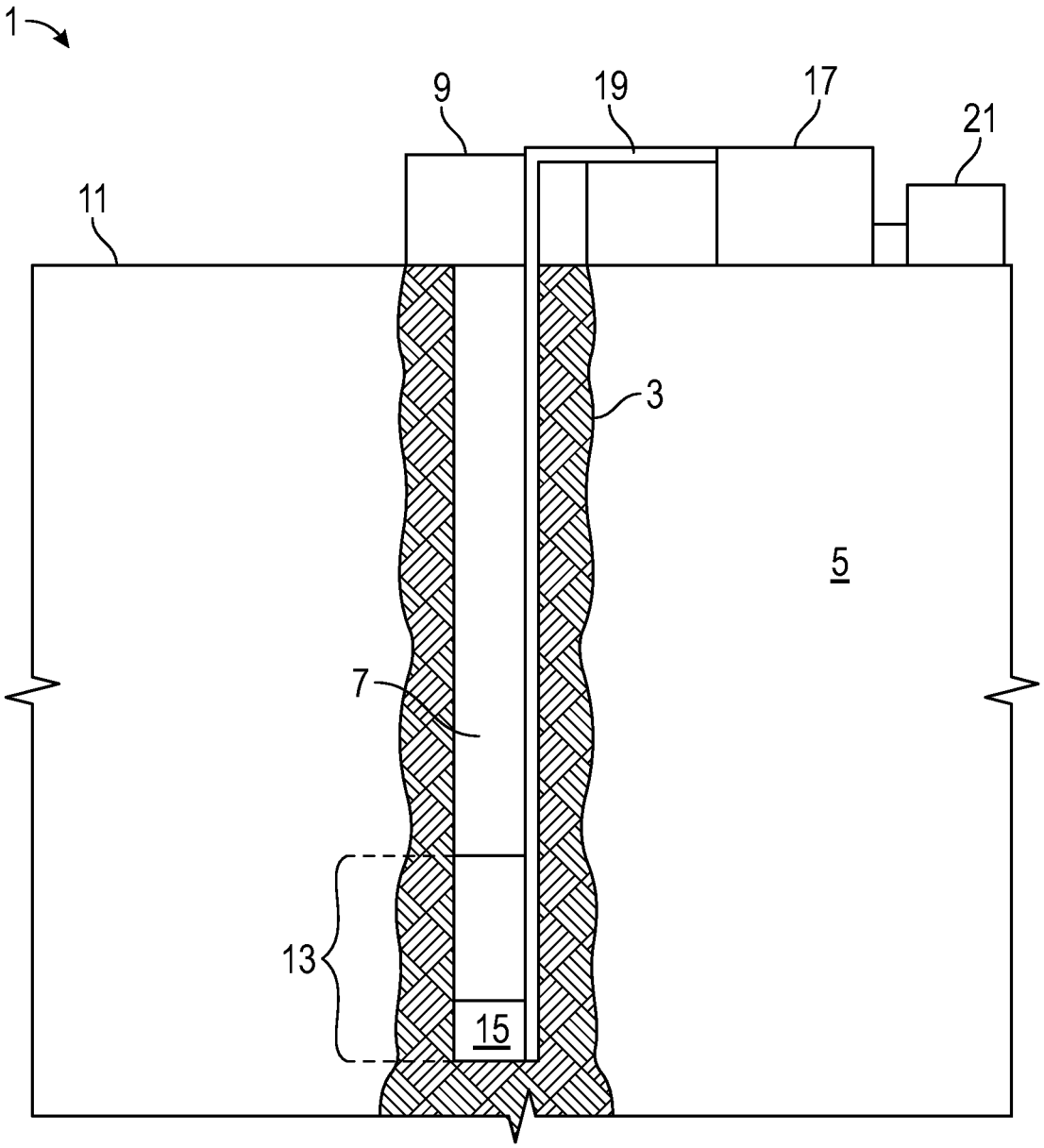
FIG. 1 shows an exemplary well site in accordance with one or more embodiments of the present disclosure.

FIG. 1 illustrates an exemplary well site 1. In general, well sites 1 may be configured in a several different ways. Therefore, the illustrated well site 1 of FIG. 1 is not intended to be limiting with respect to the particular configuration of the drilling equipment. The well site 1 is depicted as being on land. In other examples, the well site 1 is located offshore, and a marine riser is utilized for drilling.

In this example, a drilling operation at well site 1 includes drilling a wellbore 3 into a subsurface including various formations 5. In order to drill a new section of wellbore 3, a drill string 7 is suspended within the wellbore 3. The drill string 7 includes one or more drill pipes connected to form a conduit, and the drill string 7 may extend downward from a wellhead 9 at a surface location 11. The surface location 11 is any location outside of the well, such as the earth's surface. In addition, a Bottom Hole Assembly (BHA) 13 is disposed at the distal end of the drill string 7. For cutting into the subsurface rock, a drill bit 15 is utilized as a part of the BHA 13. During a drilling operation at the well site 1, in order to break rock, the drill string 7 is rotated relative to the wellbore 3 and weight is applied to the drill bit 15. In some cases, the drill bit 15 is rotated independently with a drilling motor. In other embodiments, the drill bit 15 is rotated using a combination of a drilling motor and a top drive to rotate the drill string 7.

The BHA 13 may include measurement tools, such as a measurement-while-drilling (MWD) tool or a logging-while-drilling (LWD) tool, as well as other drilling tools that are not specifically shown but would be understood to a person skilled in the art. In addition, a cable unit 17 may be provided at the surface location 11 to employ a cable 19 into the wellbore 3 via the wellhead 9. The cable 19 may be a wireline, slickline, or electric line running from the cable unit 17 through the wellhead 9 and may connect to the BHA 13. The cable 19 may be a multi-conductor, single conductor, braided, or fiber optic cable as a conveyance for the acquisition of subsurface data for a computer system 21. The computer system 21 may be coupled, wireless or wired, to the cable unit 17 for analysis of the subsurface geology, reservoir properties, and production characteristics measured within the wellbore 3.

While drilling the wellbore 3, as described above, various pieces of equipment may become disconnected or fall from the surface location 11 of the well site 1 and become lost in the downhole portion of the well site 1 (downhole portion being anywhere beneath the surface location 11). Equipment or junk that is lost or lodged downhole is called a fish. Commonly, a fish originates from a drilling operation as described above, such as the drill bit 15 or a portion of the drill string 7, but may be any other operation equipment without departing from the scope of this disclosure.

In some instances, a fish may be the BHA 13. In addition, a wire, such as a wireline, slickline, or electric line may be connected to the BHA 13 and also lost downhole in the wellbore 3. That is, the wire lost downhole in the wellbore 3, hereon referred to as a lost wire, may have been cut during operations and no longer reaches the surface location 11. One option for removing the lost wire and an associated fish in order to continue operations includes first compacting the lost wire inside the wellbore 3 above the fish and then attempting to retrieve the lost wire and the fish by a wire grab. However, this procedure typically requires multiple runs and may even cause further complications as the lost wire may become nested within the wellbore 3 when the lost wire is compacted. In addition, a wire grab may frequently fail to provide enough tension required to pull out the lost wire from the wellbore 3. Accordingly, embodiments disclosed herein present systems for and methods of removing a lost wire from a wellbore 3 through the use of a wire catcher assembly and a wire cutter assembly. As such, the disclosed systems and methods increase the rate of success for removing a lost wire from a wellbore 3, as well as reduce the operational risk of causing the lost wire to become nested within the wellbore 3.

Figure 2:
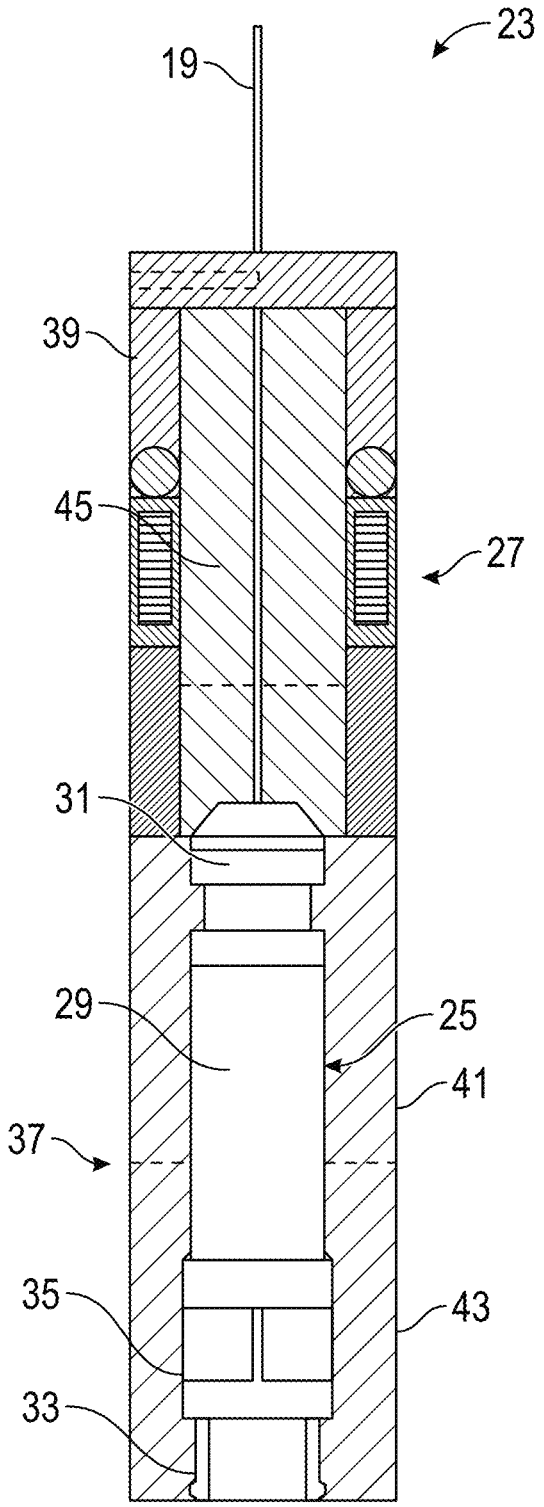
FIG. 2 shows a cross-sectional view of a wire catcher assembly and a wire cutter assembly in accordance with one or more embodiments of the present disclosure.

FIG. 2 shows a cross-sectional view of a system 23 including a wire catcher assembly 25 and a wire cutter assembly 27 in accordance with one or more embodiments of the present disclosure. The wire catcher assembly 25 is designed to catch and return a lost wire to the surface location 11 and includes a body 29, a wireline unit 31, a wire guide 33, and a gripping mechanism 35. The body 29 is tubular shaped and may be formed of a durable material such as steel. The body 29 of the wire catcher assembly 25 is lowered and raised within the wellbore 3 by the wireline unit 31. The wireline unit 31 is made up of a connection piece and a cable 19. The connection piece of the wireline unit 31 may be similar to a rope socket and is fixed to an upper end of the body 29. The cable 19 of the wireline piece is fixed to the connection piece at a first end, and a second end of the cable 19 may be attached to a positioning device at the surface location 11. The positioning device may be a cable unit 17 or another device commonly known in the art for raising and lowering wireline tools within a wellbore 3. Further, the cable 19 may be an electric wire in order to power components of the wire catcher assembly 25. As such, the cable 19 may be a multi-conductor wire, a single conductor wire, a braided wire, or a fiber optic cable.

The wire guide 33 of the wire catcher assembly 25 directs a free end of the lost wire into the body 29 while the wireline unit 31 lowers the wire catcher assembly 25 downhole in the wellbore 3. In the non-limiting example of FIG. 2, the wire guide 33 is depicted as a plurality of fingers extending downhole from the downhole end of the body 29. Alternatively, the wire guide 33 may be embodied as a tapered cylinder where an end including a smaller diameter is connected to the downhole end of the body 29. In each instance, the wire guide 33 may be formed of a durable material such as steel. Accordingly, upon reaching the free end of the lost wire while the wire catcher assembly 25 is lowered in the wellbore 3 by the wireline unit 31, the lost wire is directed into the body 29 by the wire guide 33. Specifically, the structure of the wire guide 33 forces the free end of the lost wire through an opening of the body 29 disposed at the lower end of the body 29 as the wire catcher assembly 25 is lowered over the lost wire.

The gripping mechanism 35 of the wire catcher assembly 25 is actuated to secure the lost wire within the body 29 subsequent to the lost wire entering the body 29. Here, in FIG. 2, the gripping mechanism 35 is embodied as a plurality of seals. However, the gripping mechanism 35 may be any mechanism known in the art for gripping a wire. As such, the plurality of seals may expand radially within the body 29 to seal an annular space between an interior of the body 29 and the free end of the lost wire disposed within the body 29. Alternatively, the plurality of seals may be pressed against the free end of the lost wire disposed within the body 29 by a plurality of pistons or linear actuators. The plurality of seals of the gripping mechanism 35 may be formed of elastomeric material, a durable material, such as steel, with an elastomeric outer layer, or a flexible material suited for expanding and contracting, such as Kevlar, polymers, polyesters, nanocellulose, or natural materials such as cotton, wool, silk, or linen. In addition, the gripping mechanism 35 may be in electrical connection with the cable 19 or the wireline unit 31. In this way, the gripping mechanism 35 may be actuated electrically by the wireline unit 31.

The wire cutter assembly 27 of the system 23 is designed to cut the lost wire and includes a housing 37 and a cutting element 39. The housing 37 is tubular shape and may be formed of a first pipe 41 and additional connectable pipes 43. Each of the additional connectable pipes 43 may be uniform and have a same length and a same diameter. Further, the first pipe 41 may include a threaded connection at the downhole end of the first pipe 41. Similarly, each additional connectable pipe 43 may include a similar threaded connection at the downhole end of each additional connectable pipe 43. Each additional connectable pipe 43 may further include a complementary threaded connection at the upper end of each additional connectable pipe 43 in order to connect to the first pipe 41 or another additional connectable pipe 43. Accordingly, a length of the housing 37 may be adjusted depending on the number of additional connectable pipes 43 connected together and to the first pipe 41.

In addition, the first pipe 41 and each additional connectable pipe 43 may be formed of a durable material such as steel and have inner diameters greater than an outermost diameter of the wire catcher assembly 25. In this way, as the wire cutter assembly 27 is lowered downhole in the wellbore 3, the wire cutter assembly 27 is permitted to pass over the cable 19 of the wireline unit 31 of the wire catcher assembly 25, the body 29 of wire catcher assembly 25, and the lost wire. That is, at the surface location 11, the cable 19 of the wireline unit 31 and the body 29 of the wire catcher assembly 25 are ran through an interior 45 of the wire cutter assembly 27, such that the wire cutter assembly 27 may slide over the wire catcher assembly 25 when the wire cutter assembly 27 is transported downhole in the wellbore 3.

The housing 37 of the wire cutter assembly 27 serves to position the cutting element 39 of the wire cutter assembly 27 along the lost wire in the wellbore 3. Specifically, the housing 37 is lowered from the surface location 11 over a fish connected to the lost wire in order to position the cutting element 39 at an optimal cutting location along the lost wire. The optimal cutting location along the lost wire is a portion of the lost wire just above the connection between the lost wire and the fish. The connection between the lost wire and the fish may be a rope socket of the fish disposed at an upper end of the fish. As such, the lost wire may be cut as close as possible to the upper end of the rope socket, thereby increasing the success rate of a fishing job employed at a later time to remove the fish from the wellbore 3.

The cutting element 39 is designed to cut through the lost wire at the optimal cutting location and is disposed above the housing 37 within the wire cutter assembly 27. The cutting element 39 may be a milling knife, a blade, or another suitable apparatus capable of severing the many types of wires commonly utilized in the oil and gas industry. Further, the cutting element 39 may be formed of a durable material such as steel, tempered steel, or tungsten carbide. In addition, the cutting element 39 may be actuated hydraulically. The structure and operational sequence of the cutting element 39 and the wire cutter assembly 27 are further detailed in FIGS. 4A and 4B, which show the wire cutter assembly 27 before and after cutting the lost wire, respectively, in accordance with one or more embodiments of the present disclosure.

Figure 3A:
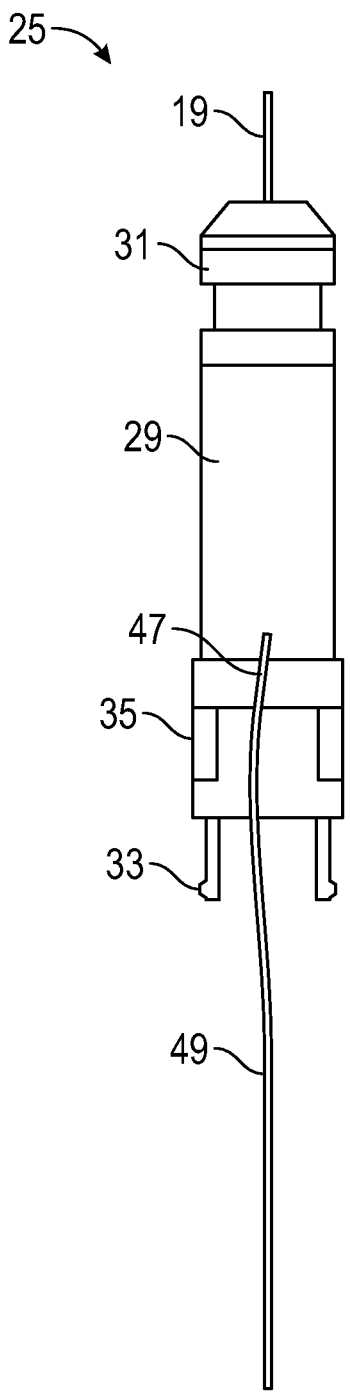
FIGS. 3A and 3B show diagrams depicting an operational sequence of a wire catcher assembly in accordance with one or more embodiments.
Figure 3B:
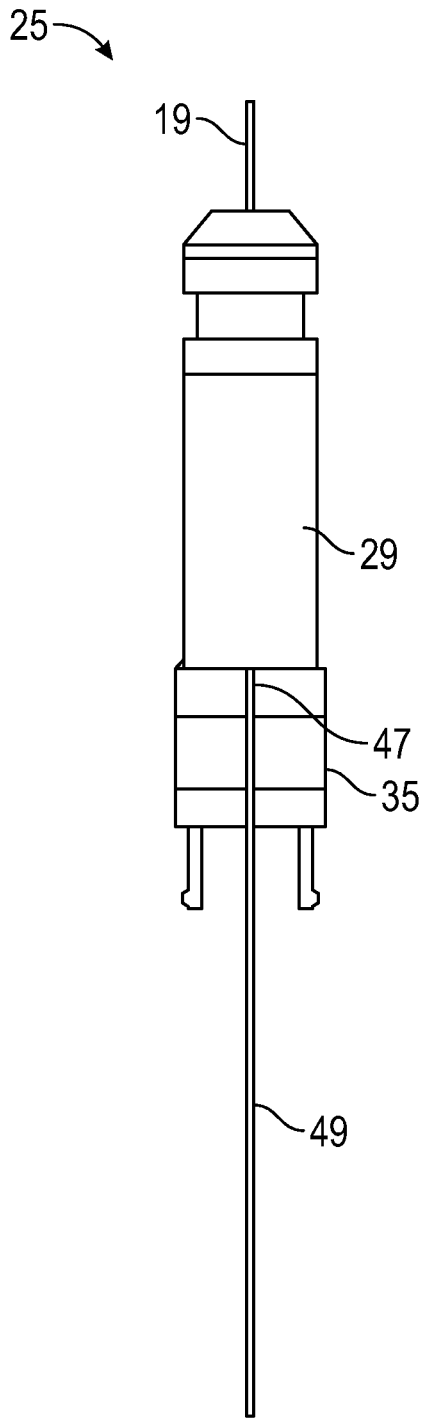

FIGS. 3A and 3B show diagrams depicting an operational sequence of a wire catcher assembly 25 in accordance with one or more embodiments. Specifically, FIG. 3A depicts a wire catcher assembly 25 being lowered over a free end 47 of a lost wire 49 attached to a fish in a wellbore 3. The wire catcher assembly 25 is lowered from the surface location 11 towards the lost wire 49 of the fish by the wireline unit 31 of the wire catcher assembly 25. Accordingly, as the wire catcher assembly 25 is lowered over the free end 47 of the lost wire 49, the free end 47 of the lost wire 49 enters the body 29 of the wire catcher assembly 25 through an opening of the body 29. The opening of the body 29 is located at the downhole end of the body 29. Further, the free end 47 of the lost wire 49 is directed through the opening of the body 29 into the body 29 by the wire guide 33 of the wire catcher assembly 25.

Subsequent to the free end 47 of the lost wire 49 entering the body 29, the gripping mechanism 35 of the wire catcher assembly 25 is actuated. The gripping mechanism 35 may be actuated electronically by the cable 19 of the wireline unit 31. In this case, the cable 19 of the wireline unit 31 and the gripping mechanism 35 are in electronic communication. As such, an operator of the system 23 at the surface location 11 may send a signal through the cable 19 to the gripping mechanism 35 in order to actuate the gripping mechanism 35. Further, power may be supplied to the gripping mechanism 35 from the surface location 11 through the cable 19 in order to power components of the gripping mechanism 35. Alternatively, the gripping mechanism 35 may be actuated by battery powered mechanisms. These battery powered mechanisms may be controlled by the operator of the system 23 at the surface location 11.

As seen in FIG. 3B, a plurality of seals of the gripping mechanism 35 are expanded to press against the free end 47 of the lost wire 49 disposed within the body 29 upon actuation of the gripping mechanism 35. Consequently, the free end 47 of the lost wire 49 is secured within the body 29 of the wire catcher assembly 25 between the plurality of seals firmly pressing against the lost wire 49. In additional embodiments of the system 23, the plurality of seals may be pressed against the lost wire 49 by a plurality of pistons or linear actuators. The pistons may be pre-pressurized pistons, and the pistons may be released through a low-power control system powered by a battery or the cable 19 or the wireline unit 31. Similarly, the linear actuators may be powered by a by a battery or the cable 19 of the wireline unit 31.

Figure 4A:
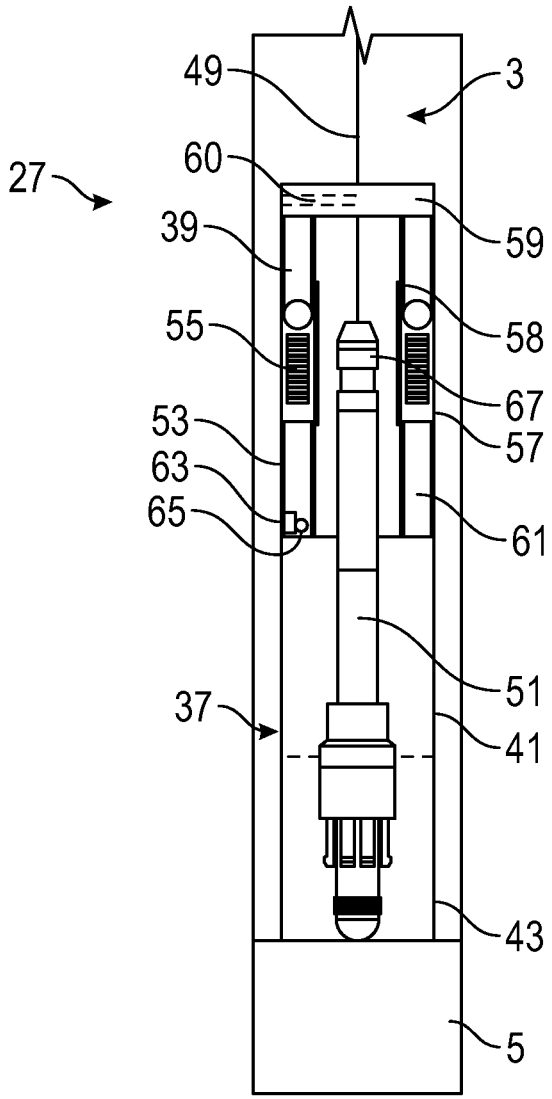
FIGS. 4A and 4B show diagrams depicting an operational sequence of a wire cutter assembly in accordance with one or more embodiments.
Figure 4B:
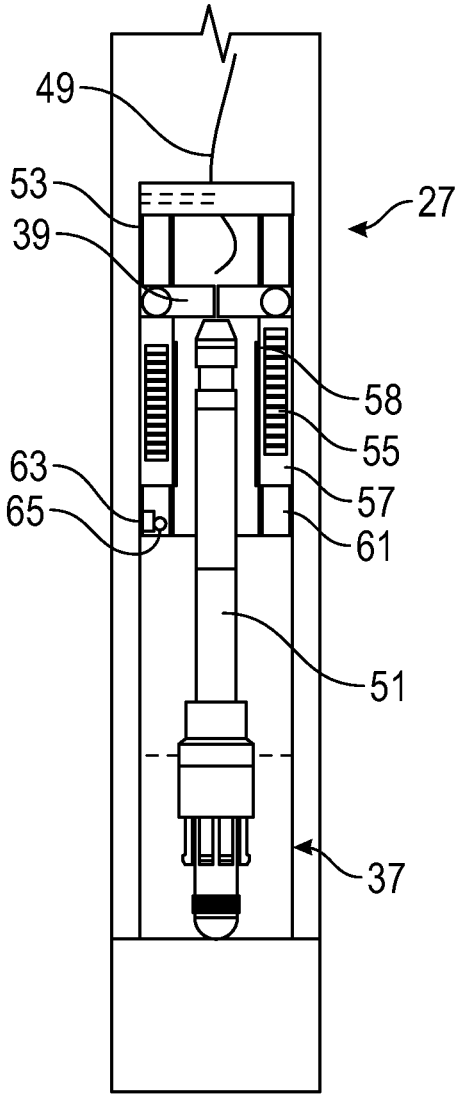

FIGS. 4A and 4B show diagrams depicting an operational sequence of a wire cutter assembly 27 in accordance with one or more embodiments. Specifically, FIG. 4A depicts the wire cutter assembly 27 subsequent to being lowered over a fish 51 lost in the wellbore 3. In this embodiment of the wire cutter assembly 27, the wire cutter assembly 27 further includes a casing 53, a spring 55, a piston 57, a sleeve 58, and a wire centralizer 59. As such, the spring 55, the piston 57, and the sleeve 58 are utilized to hydraulically actuate the cutting element 39 of the wire cutter assembly 27.

The casing 53 is embodied as a steel tube with an outer wall and an inner wall. The diameter of the outer wall of the casing 53 may be the same as an outer diameter of the housing 37. The diameter of the inner wall of the casing 53 is greater than the outermost diameter of the wire catcher assembly 25. The spring 55 and the piston 57 are disposed within a space between the outer wall of the casing 53 and the inner wall of the casing 53. The spring 55 is a compression spring and may be formed of high-carbon, alloy, or stainless steel. The piston 57 may be a single acting piston, which when actuated moves in a single, linear direction. Further, the piston 57 may be formed of low carbon steel or an aluminum alloy and include a cylindrical body and a plunger. The cylindrical body may be fixed within the space between the outer wall and the inner wall of the casing 53. An upper end of the spring 55 may be fixed to the cylindrical body of the piston 57 while a lower end of the spring 55 may be fixed to the plunger of the piston 57. In addition, a sealing element may be attached to the free end of the plunger. The sealing element may be formed of an elastomeric material and isolates the spring 55 and the piston 57 from a hydraulic chamber 61. The hydraulic chamber 61 is disposed within the space between the outer wall and the inner wall of the casing 53 and is situated between the sealing element and the lower end of the casing 53.

The hydraulic chamber 61 is pre-pressurized with a hydraulic fluid or air at the surface location 11. A valve 63 may be disposed along the outer wall of the casing 53 in the hydraulic chamber 61. The valve 63 may be any valve known in the art such as a gate valve. In FIGS. 4A and 4B, the valve 63 is depicted as connecting the hydraulic chamber 61 and the wellbore 3. In this way, when the valve 63 is closed, the pressurized fluid or air is prevented from entering the wellbore 3. However, when the valve 63 is open, the pressurized fluid or air exits the hydraulic chamber 61 and enters the wellbore 3.

The valve 63 is controlled by a timer 65. Prior to the wire cutter assembly 27 being lowered in the wellbore 3, the valve 63 is closed, and the hydraulic chamber 61 is pre-pressurized with fluid or air at the surface location 11. In addition, the timer 65 connected to the valve 63 is preset at the surface location 11. When the timer 65 reaches a preset time, the timer 65 actuates the valve 63, thereby opening the valve 63.

In the non-limiting example of FIG. 4A, the housing 37 of the wire cutter assembly 27 includes a single additional connectable pipe 43 attached to the first pipe 41 of the housing 37. Here, the downhole end of the additional connectable pipe 43 rests against the formation 5 at the downhole end of the wellbore 3. In this way, the housing 37 positions the cutting element 39 of the wire cutter assembly 27 above a rope socket 67 of the fish 51.

Alternatively, in the instance that the fish 51 includes a component with an outer diameter greater than the inner diameters of the first pipe 41 and additional connectable pipes 43 of the housing 37, the lower end of the housing 37 may rest against this component of the fish 51 subsequent to the wire cutter assembly 27 being lowered over the fish 51. As such, the number of additional connectable pipes 43 connected to the first pipe 41 may be adjusted in order to position the cutting element 39 of the wire cutter assembly 27 as close as possible to the optimal cutting location along the lost wire 49.

Furthermore, in FIG. 4A, the valve 63 of the hydraulic chamber 61 is closed. In this way, the pressurized fluid or air within the hydraulic chamber 61 presses against the sealing element and the plunger of the piston 57, thereby compressing the spring 55. In addition, while the spring 55 is in compression, the cutting element 39 of the wire cutting assembly is locked against the casing 53 by the sleeve 58.

The sleeve 58 may be a steel tube or pipe situated within the interior of the inner wall of the casing 53. A downhole end of the sleeve 58 is connected to the plunger of the piston 57. As such, when the spring 55 expands and drives the plunger of the piston 57 downwards within the casing 53, the sleeve 58 is also driven downwards within the interior of the inner wall of the casing 53. When the valve 63 is closed and the spring 55 is compressed, the sleeve 58 is positioned by the piston 57 such that an upper end of the sleeve 58 locks the cutting element 39 against the casing 53. That is, the sleeve 58 prevents the cutting element 39 from being driven through the lost wire 49 while the sleeve 58 and the cutting element 39 are in contact.

In addition, in one or more embodiments, a wire centralizer 59 may be connected to the upper end of the casing 53. The wire centralizer 59 may be formed of metal, such as steel, or a durable polymer material, and is shaped as a disk that covers the interior of the inner wall of the casing 53 and the space between the outer wall and inner wall of the casing 53 when in a closed position. The disk of the wire centralizer 59 may include a slot 60 permitting the lost wire 49 to pass through the wire centralizer 59. The slot 60 of the wire centralizer 59 may extend from the outer edge of the wire centralizer 59 to the center of the wire centralizer 59, and have a thickness similar to the thickness of the lost wire 49.

Further, the wire centralizer 59 may be a flapper type and include a hinge disposed along the edge of the disk of the wire centralizer 59, opposite from the end of the slot 60, connecting the disk of the wire centralizer 59 to the casing 53. In this way, when the wire cutter assembly 27 is lowered over the wire catcher assembly 25, the wire centralizer 59 may swing open when in contact with the wire catcher assembly 25, allowing the wire catcher assembly 25 to pass through the wire cutter assembly 27. Subsequent to the wire catcher assembly 25 exiting the wire cutter assembly 27, the wire centralizer 59 may return to the closed position, as seen in FIG. 4A. In this position, the lost wire 49 may run through the slot 60 of the wire centralizer 59. As such, the wire centralizer 59 helps to centralize the lost wire 49 and fish 51 within the wire cutter assembly 27 prior to the actuation of the cutting element 39.

In FIG. 4B, the preset time of the timer 65 has expired. Consequently, the valve 63 is opened, thereby causing the fluid or air to exit the hydraulic chamber 61 through the valve 63 and enter the wellbore 3. As a result of the fluid or air exiting the hydraulic chamber 61, the force acting against the sealing element and the piston 57 weakens. Accordingly, when the spring force becomes greater than the force acting against the piston 57, the spring 55 expands and drives the plunger of the piston 57 downwards within the space between the outer wall and the inner wall of the casing 53. As the spring 55 expands and the plunger of the piston 57 moves outwardly, in an axial direction, from the cylindrical body of the piston 57 into the space between the outer wall and the inner wall of the casing 53, the sleeve 58 moves downhole within the interior of the inner wall of the casing 53 along the inner wall of the casing 53. When the spring 55 is fully expanded, the sleeve 58 and the cutting element 39 are no longer in contact. Consequently, the cutting element 39 is unlocked from the casing 53.

Subsequently, the cutting element 39 rotates towards the lost wire 49 and cuts through the lost wire 49 above the rope socket 67 of the fish 51. In a non-limiting example, the cutting element 39 may be rotated towards the lost wire 49 by a torsion spring or by gravity. Further, the cutting element 39 may stay unlocked from the casing 53 until the cutting element 39 is preset again at the surface location 11. Similarly, the spring 55 may stay expanded until the hydraulic chamber 61 is repressurized at the surface location 11.

Figure 5D:
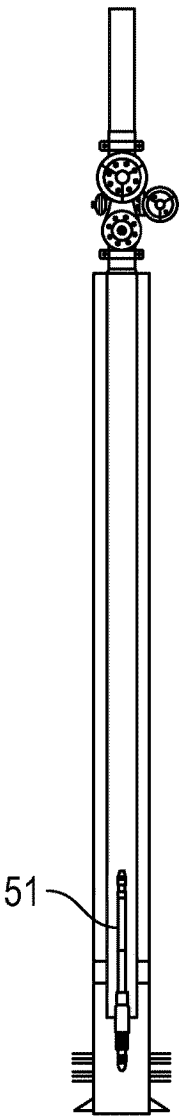
FIGS. 5A-5D show diagrams depicting an operational sequence of the system in accordance with one or more embodiments.
Figure 5C:
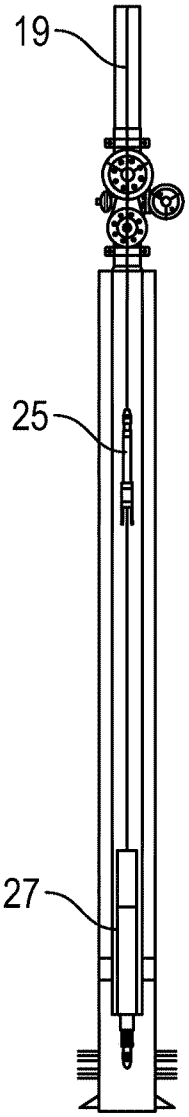
Figure 5B:
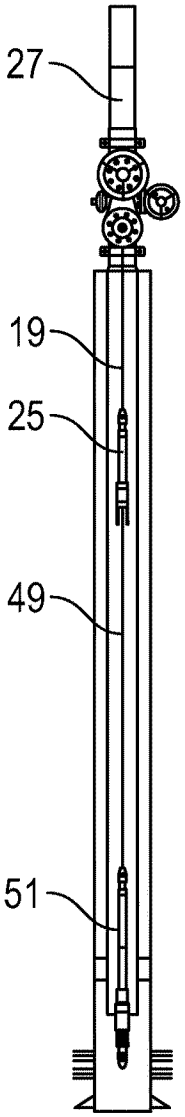
Figure 5A:
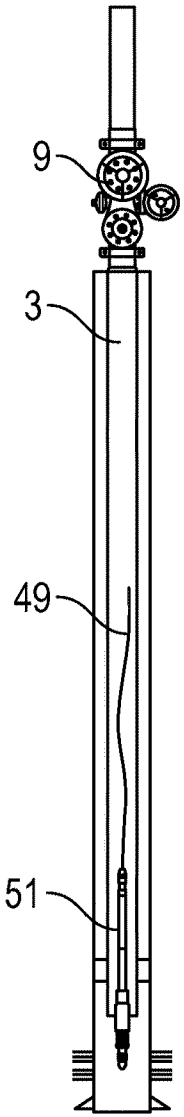

FIGS. 5A-5D show diagrams depicting an operational sequence of the system 23 in accordance with one or more embodiments. FIG. 5A depicts a fish 51 lost in a wellbore 3.

A lost wire 49 is connected to the fish 51 and no longer reaches the surface location 11.

Prior to deploying the system 23, an operator of the system 23 may determine the dimensions of the fish 51 lost in the wellbore 3. Accordingly, the length of the housing 37 is adjusted such that the housing 37 will position the cutting element 39 above the fish 51 and along the lost wire 49 when the wire cutter assembly 27 swallows the fish 51 or reaches the downhole end of the wellbore 3 after being deployed. The length of the housing 37 is adjusted by altering the number of additional connectable pipes 43 connected to the first pipe 41.

FIG. 5B depicts the system 23, according to one or more embodiments, being deployed to retrieve the lost wire 49. Here, the wire catcher assembly 25 is lowered from the surface location 11, through a wellhead 9 and the wire cutter assembly 27, into the wellbore 3 by the wireline unit 31 of the wire catcher assembly 25. Once the wire catcher assembly 25 is lowered over the free end 47 of the lost wire 49, the free end 47 of the lost wire 49 is secured within the body 29 of the wire catcher assembly 25 by the gripping mechanism 35. Subsequent to the free end 47 of the lost wire 49 being secured within the wire catcher assembly 25, the wireline unit 31 raises the wire catcher assembly 25 within the wellbore 3 until the lost wire 49 becomes taunt between the wire catcher assembly 25 and the fish 51.

The wire cutter assembly 27 may remain at the surface location 11 until the lost wire 49 is held under tension between the wire catcher assembly 25 and the fish 51. In FIG. 5B, the wire catcher assembly 25 and the wire cutter assembly 27 are depicted as being deployed separately. However, the wire catcher assembly 25 and the wire cutter assembly 27 may be deployed together, as shown in FIG. 2. That is, in one or more other embodiments, the wire catcher assembly 25 and the wire cutter assembly 27 may be joined at the surface location 11 and lowered within the wellbore 3 together by the wireline unit 31 of the wire cutter assembly 27. The wire catcher assembly 25 and the wire cutter assembly 27 may be joined to one another until the wire catcher assembly 25 has secured the lost wire 49 and placed the lost wire 49 under tension between the wire catcher assembly 25 and the fish 51 by raising the wire catcher assembly 25 upwards in the wellbore 3 with the use of the wireline unit 31. Once the lost wire 49 is placed under tension between the wire catcher assembly 25 and the fish 51, the wire cutter assembly 27 may detach from the wire catcher assembly 25. Subsequently, the wire cutter assembly 27 may be lowered downhole in the wellbore 3 towards the fish 51 by gravity.

The wire catcher assembly 25 and the wire cutter assembly 27 may be joined together by pins of the wire catcher assembly 25. When the wire catcher assembly 25 and the wire cutter assembly 27 are connected, the pins of the wire catcher assembly 25 may extend from the body 29 of the wire catcher assembly 25 through apertures along an interior wall of the first pipe 41 of the housing 37 of the wire cutter assembly 27. The pins of the wire catcher assembly 25 may be in electrical communication with the wireline unit 31. In order to detach the wire cutter assembly 27 from the wire cutter assembly, an electrical signal may be sent through the cable 19 of the wireline unit 31 in order to actuate the pins electronically. Consequently, the pins may retract out of the apertures of the wire cutter assembly 27, towards the wire catcher assembly 25. In this way, the wire cutter assembly 27 is released from the wire catcher assembly 25 and may travel independently downhole towards the fish 51.

Those skilled in the art would appreciate that the arrangement depicted in FIG. 2 is not the only way in which the wire catcher assembly 25 and wire cutter assembly 27 may be joined to one another. In additional embodiments, the wire catcher assembly 25 and the wire cutter assembly 27 may be arranged in a stacked configuration. For example, the upper end of the wire cutter assembly 27 may be removably attached to the lower end of the wire catcher assembly 25, such that the wire catcher assembly 25 is stacked on top of the wire cutter assembly 27 when joined together.

Alternatively, and as depicted by FIGS. 5B and 5C, the wire cutter assembly 27 may be lowered from the surface location 11 within the wellbore 3 separately from the wire catcher assembly 25 by gravity. While traveling downhole in the wellbore 3, the wire cutter assembly 27 slides over the cable 19 of the wireline unit 31, the body 29 of the wire catcher assembly 25, the lost wire 49 in tension between the wire catcher assembly 25 and the fish 51, and finally the fish 51. Once the lower end of the housing 37 of the wire cutter assembly 27 rests against the formation 5 at the downhole end of the wellbore 3, as depicted in FIG. 5C, the cutting element 39 is thereby positioned along the lost wire 49 above the fish 51. Specifically, the cutting element 39 may be positioned just above a rope socket 67 of the fish 51.

Subsequent to a preset time of the timer 65 of the wire cutter assembly 27 expiring, the wire cutter assembly 27 may be hydraulically actuated, thereby causing the cutting element 39 of the wire cutter assembly 27 to cut through the lost wire 49. Accordingly, subsequent to the lost wire 49 being cut by the wire cutter assembly 27, the wireline unit 31 of the wire catcher assembly 25 may return the wire catcher assembly 25, along with the lost wire 49 secured to the wire catcher assembly 25, to the surface location 11.

In FIG. 5D, a fishing operation has been run to return the wire cutter assembly 27 to the surface location 11. Subsequently, an additional fishing operation may be run to retrieve the fish 51 from the wellbore 3. The fishing operation to return the wire cutter assembly 27 and the additional fishing operation to retrieve the fish 51 may be performed using any fishing method known in the art.

Figure 6:
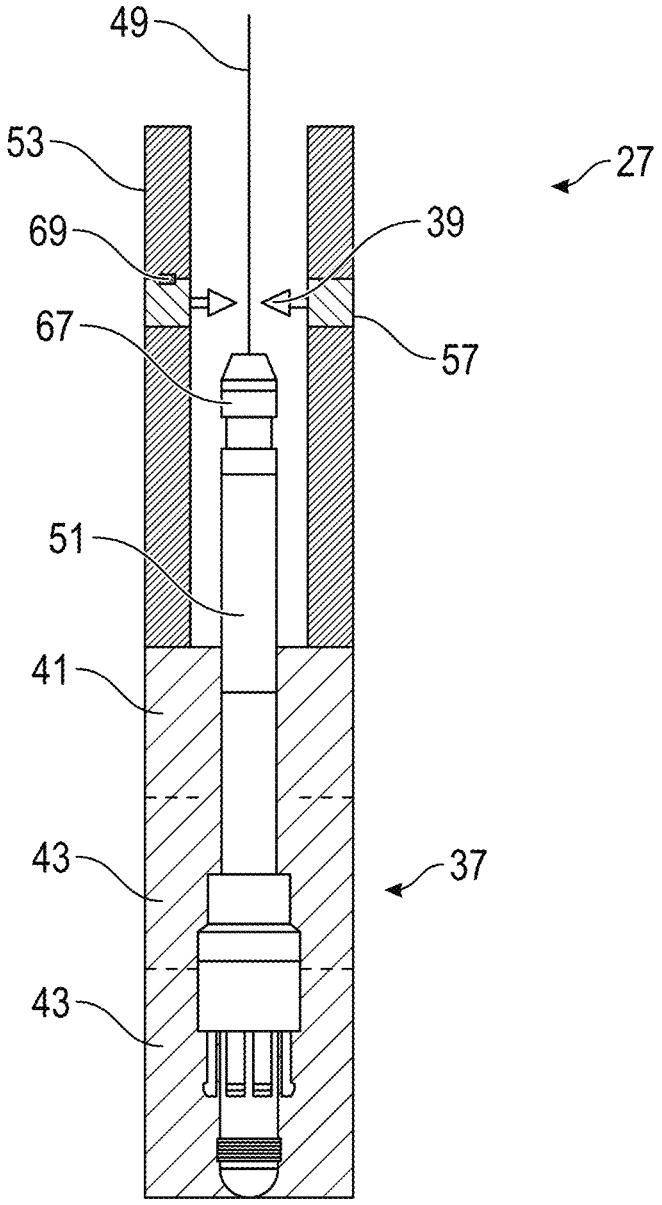
FIG. 6 shows a cross-sectional view of a wire catcher assembly and a wire cutter assembly in accordance with one or more embodiments of the present disclosure.

FIG. 6 depicts another embodiment of a wire cutter assembly 27. In this embodiment, the wire cutter assembly 27 includes a plurality of cutting elements 39 and a plurality of pistons 57. Each cutting element 39 is attached to a single piston 57 of the plurality of pistons 57. Further, each piston 57 of the plurality of pistons 57 is pre-pressurized at the surface location 11 and includes a cylindrical body and a plunger. The cylindrical body of each piston 57 of the plurality of pistons 57 is fixed between the outer wall of the casing 53 and the inner wall of the casing 53. The plunger of each piston 57 of the plurality of pistons 57 extends in a radial direction. That is, each plunger extends outwardly from each cylindrical body towards the lost wire 49 upon actuation of the plurality of pistons 57 through apertures along the inner wall of the casing 53. Each piston 57 of the plurality of pistons 57 may be actuated by a timer 65 or by a low-power control system 69 powered by a battery. From the surface location 11, a signal may be sent to the control system 69 in order to actuate the plurality of pistons 57. In turn, the plurality of cutting elements 39 are driven towards and through the lost wire 49 by the plungers of the plurality of pistons 57.

Further, in this particular embodiment of the wire cutter assembly 27, the housing 37 of the wire cutter assembly 27 includes two additional connectable pipes 43 attached to the first pipe 41 of the housing 37. Here, the downhole end of the lower additional connectable pipe 43 rests against the formation 5 at the downhole end of the wellbore 3, and the downhole end of the upper additional connectable pipe 43 is connected to an upper end of the lower additional connectable pipe 43.

Figure 7:
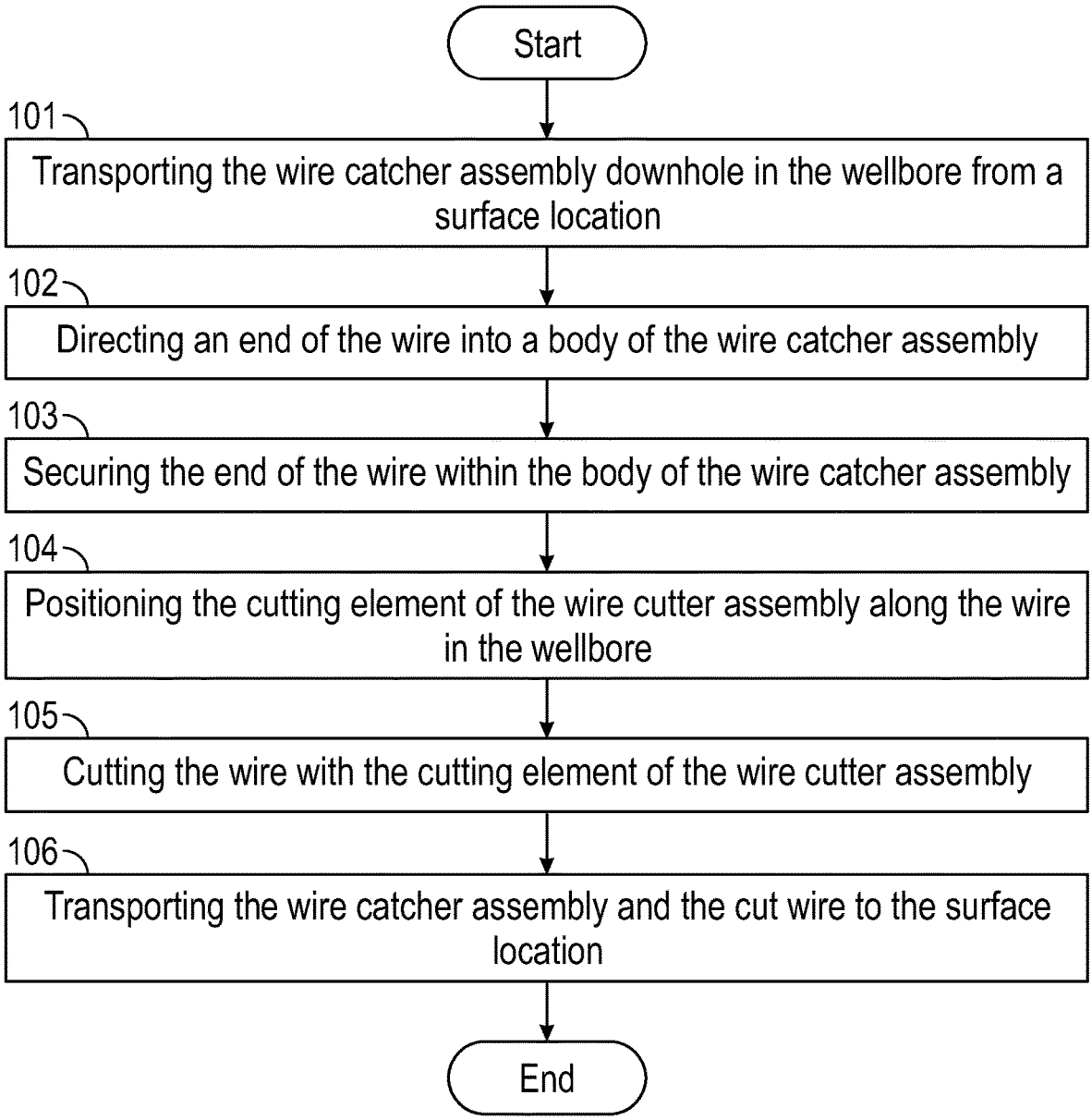
FIG. 7 shows a flowchart of a method in accordance with one or more embodiments of the present disclosure.

FIG. 7 depicts a flowchart showing a method of removing a lost wire 49 from a wellbore 3. While the various flowchart blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 101, the wire catcher assembly 25 is transported downhole in the wellbore 3 from the surface location 11 towards a lost wire 49 of a fish 51 in the wellbore 3 by the wireline unit 31 of the wire catcher assembly 25. In addition, the wireline unit 31 of the wire catcher assembly 25 may transport the wire cutter assembly 27 downhole in the wellbore 3 if the wire cutter assembly 27 and the wire catcher assembly 25 are joined at the surface location 11.

In block 102, the wire catcher assembly 25 is lowered over a free end 47 of the lost wire 49. In this way, the free end 47 of the lost wire 49 is directed into the body 29 of the wire catcher assembly 25 by the wire guide 33 of the wire catcher assembly 25 as the wire catcher assembly 25 is lowered over the lost wire 49 by the wireline unit 31. Specifically, the free end 47 of the lost wire 49 enters the wire guide 33 through the downhole end of the wire guide 33 and is directed into an opening of the body 29 at the downhole end of the body 29 by the structure of the wire guide 33.

In block 103, the free end 47 of the lost wire 49 is secured within the body 29 of the wire catcher assembly 25 by the gripping mechanism 35 of the wire catcher assembly 25 subsequent to the free end 47 of the lost wire 49 entering the body 29. The gripping mechanism 35 may be actuated electronically by battery powered mechanisms controlled at the surface location 11. In other embodiments, the gripping mechanism 35 may be actuated electronically by the cable 19 of the wireline unit 31.

In one or more embodiments, upon actuation of the gripping mechanism 35, a plurality of seals may be pressed against the lost wire 49 by a plurality of pistons or linear actuators in order to secure the wire within the body 29. Alternatively, in one or more embodiments, upon actuation of the gripping mechanism 35, a plurality of seals may be expanded, thereby securing the lost wire 49 within the body 29 by sealing the space between a wall of the body 29 and the lost wire 49.

Subsequent to the gripping mechanism 35 of the wire catcher assembly 25 securing the lost wire 49 within the wire catcher assembly 25, the wireline unit 31 of the wire catcher assembly 25 may raise the wire catcher assembly 25 within the wellbore 3 until the lost wire 49 is taunt between the wire catcher assembly 25 and the fish 51.

In block 104, the wire cutter assembly 27 is lowered over the fish 51 in the wellbore 3 in order to position the cutting element 39 of the wire cutter assembly 27 along the lost wire 49. In one or more embodiments, the wire cutter assembly 27 may be lowered into the wellbore 3 from the surface location 11 by the wireline unit 31 of the wire catcher assembly 25 if the wire catcher assembly 25 and the wire cutter assembly 27 are joined together at the surface location 11. In such embodiments, the wire cutter assembly 27 may detach from the wire catcher assembly 25 subsequent to the wireline unit 31 placing the lost wire 49 in tension between the wire catcher assembly 25 and the fish 51. After detaching from the wire catcher assembly 25, the wire cutter assembly 27 may be transported from the wire catcher assembly 25 to the downhole end of the wellbore 3, passing over the fish 51, by gravity.

However, in one or more embodiments, the wire catcher assembly 25 and the wire cutter assembly 27 may not be joined at the surface location 11. In this way, the wire catcher assembly 25 and the wire cutter assembly 27 are transported downhole in the wellbore 3 separately. In such embodiments, the wire cutter assembly 27 may be lowered from the surface location 11 to the fish 51 in the wellbore 3 by gravity.

Prior to the wire cutter assembly 27 being transported downhole in the wellbore 3, an operator of the system 23 may identify the dimensions of the fish 51 lost downhole in the wellbore 3. The dimensions of the fish 51 may be identified by previous knowledge of the fish 51 or by utilizing any equipment know in the art capable of measuring or determining the dimensions of fish 51 in a wellbore 3.

Subsequent to identifying the dimensions of the fish 51 in the wellbore 3, the length of the housing 37 of the wire cutter assembly 27 may be adjusted. That is, a number of additional connectable pipes 43 may be connected to the first pipe 41 of the housing 37 in order to set the length of the housing 37 to a desired length. In this way, the length of the housing 37 may adjusted depending on the dimensions and components of the fish 51. Accordingly, if an operator of the system 23 determines that the fish 51 includes components that have an outer diameter greater than the inner diameter of the housing 37, the length of the housing is selected such that the lower end of the housing 37 shall rest against said components. Alternatively, if the operator of the system 23 determines that the fish 51 does not include any components with an outer diameter greater than the inner diameter of the housing 37, the length of the housing is selected such that the lower end of the housing 37 shall rest against the downhole end of the wellbore 3. In either fashion, the housing 37 will position the cutting element 39 along the lost wire 49 above the upper end of the fish 51 after the wire cutter assembly 27 is deployed.

In block 105, subsequent to the housing 37 of the wire cutter assembly 27 positioning the cutting element 39 along the lost wire 49, the cutting element 39 is actuated. Accordingly, the cutting element 39 cuts through the lost wire 49 above the upper end of the fish 51, thereby separating the lost wire 49 and the fish 51.

In block 106, subsequent to the cutting element 39 of the wire cutter assembly 27 cutting the lost wire 49, the wire catcher assembly 25 is returned to the surface location 11 by the wireline unit 31. In addition, since the free end 47 of the lost wire 49 is secured within the body 29 of the wire catcher assembly 25, the lost wire 49 is returned to the surface location 11 along with the wire catcher assembly 25. Once the wellbore 3 is clear of the wire catcher assembly 25 and the lost wire 49, a fishing operation may be run in order to retrieve the wire cutter assembly 27 from the wellbore 3. Further, subsequent to the wire cutter assembly 27 returning to the surface location 11, an additional fishing operation may be run in order to remove the fish 51 from the wellbore 3. The aforementioned fishing operation and additional fishing operation to remove the wire cutter assembly 27 and the fish 51 from the wellbore 3, respectively, may be performed using any fishing method known in the art.

Accordingly, the aforementioned embodiments as disclosed relate to systems 23 and methods useful for removing a wire lost downhole in a wellbore 3 from the wellbore 3, even when the lost wire 49 is attached a fish 51. The disclosed systems 23 for and methods of removing a lost wire 49 from a wellbore 3 advantageously increase the rate of success for removing a lost wire 49 from a wellbore 3, as well as reduce the operational risk of causing the lost wire 49 to become nested within the wellbore 3. In turn, these benefits advantageously reduce additional rig time and associated costs.

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system for fishing a wire lost downhole in a wellbore, the system comprising:

a wire catcher assembly comprising:

a body configured to encase an end of the wire;

a wire guide attached to the body and configured to direct the end of the wire into the body;

a gripping mechanism configured to secure the wire within the body; and a wireline unit configured to move the wire catcher assembly within the wellbore; and a wire cutter assembly comprising;

a cutting element configured to cut the wire; and a housing configured to position the cutting element along the wire in the wellbore;

wherein the wire cutter assembly is slidable over the wire catcher assembly.

2. The system according to claim 1, wherein the housing of the wire cutter assembly comprises a diameter greater than a diameter of the body of the wire catcher assembly.

3. The system according to claim 1, wherein a length of the housing is adjustable.

4. The system according to claim 1, wherein the wireline unit comprises an electric cable that electrically actuates the gripping mechanism of the wire catcher assembly.

5. The system according to claim 1, wherein the cutting element of the wire cutter assembly is hydraulically actuated.

6. The system according to claim 5, wherein the wire cutter assembly further comprises:

a piston configured to unlock the cutting element when actuated; and a spring pre-loaded by hydraulic pressure at a surface location, the spring configured to actuate the piston when released;

wherein the cutting element is driven through the wire in order to cut the wire subsequent to being unlocked.

7. The system according to claim 6, wherein the wire cutter assembly further comprises a timer pre-set at the surface location, the timer configured to release the spring.

8. A method for fishing a wire lost downhole in a wellbore, the method comprising:

transporting, by a wireline unit, a wire catcher assembly and a wire cutter assembly downhole in the wellbore from a surface location;

directing, by a wire guide of a wire catcher assembly, an end of the wire into a body of the wire catcher assembly;

securing, by a gripping mechanism of the wire catcher assembly, the end of the wire within the body of the wire catcher assembly;

sliding the wire cutter assembly over the wire catcher assembly;

positioning, by a housing of a wire cutter assembly, a cutting element of the wire cutter assembly along the wire in the wellbore;

cutting the wire with the cutting element of the wire cutter assembly; and transporting, by the wireline unit, the wire catcher assembly and the cut wire to the surface location.

9. The method according to claim 8, further comprising identifying dimensions of a fish lost downhole in the wellbore, wherein the wire is attached to the fish.

10. The method according to claim 8, wherein transporting the wire catcher assembly downhole in the wellbore further comprises transporting the wire cutter assembly downhole in the wellbore by the wireline unit.

11. The method according to claim 8, wherein securing the end of the wire within the body of the wire catcher assembly further comprises actuating the gripping mechanism electrically by an electric cable of the wireline unit.

12. The method according to claim 8, wherein subsequent to securing the end of the wire within the body of the wire catcher assembly, raising the wire catcher assembly within the wellbore by the wireline unit in order to place the wire under tension between the wire catcher assembly and a fish attached to wire.

13. The method according to claim 8, further comprising lowering the wire cutter assembly downhole in the wellbore from the surface location by gravity.

14. The method according to claim 8, wherein positioning the cutting element of the wire cutter assembly along the wire in the wellbore further comprises sliding the housing of the wire cutter assembly over a fish attached to the wire.

15. The method according to claim 8, wherein cutting the wire with the cutting element of the wire cutter assembly further comprises actuating the cutting element hydraulically subsequent to a timer releasing a spring, thereby actuating a piston configured to unlock the cutting element upon the spring being released.

16. The method according to claim 8, further comprising running a fishing operation to return the wire cutter assembly to the surface location from the wellbore subsequent to transporting the wire catcher assembly and the cut wire to the surface location.

17. The method according to claim 9, further comprising adjusting a length of the housing of the wire cutter assembly at the surface location based on the dimensions identified of the fish.

18. The method according to claim 10, further comprising joining the wire cutter assembly and the wire catcher assembly at the surface location.

19. The method according to claim 16, further comprising running an additional fishing operation to remove a fish from the wellbore subsequent to transporting the wire cutter assembly to the surface location.

* * * * *